US006082033A

United States Patent [19]

Skinner

[11] Patent Number: 6,082,033

[45] Date of Patent: Jul. 4, 2000

[54] PICTURE FRAMED POSTCARD

[75] Inventor: Gary Raymond Skinner, Greenvale, Australia

[73] Assignee: Scandice Pty. Ltd., Tullamarine, Australia

[21] Appl. No.: 09/020,581

[22] Filed: Jan. 30, 1998

[30] Foreign Application Priority Data

Jan. 31, 1997 [AU] Australia ..... P04889

[51] Int. Cl.[7] ..... A47G 1/16; A47G 1/06

[52] U.S. Cl. ..... 40/750; 40/754; 40/755; 40/765

[58] Field of Search ..... 40/765, 766, 750, 40/754, 755, 756, 152.1, 124.17, 124.18; 248/351, 441.1, 455

[56] References Cited

U.S. PATENT DOCUMENTS

| | | | |
|---|---|---|---|
| 1,421,097 | 6/1922 | Pente | 40/754 |
| 2,172,273 | 9/1939 | Chilcote | 40/755 |
| 2,182,515 | 12/1939 | Chilcote | 40/765 |
| 2,647,834 | 8/1953 | Rabkin et al. | 430/496 |
| 2,782,542 | 2/1957 | Blevens | 40/754 |
| 3,883,255 | 5/1975 | Little | 402/61 |
| 3,894,684 | 7/1975 | Florey | 229/92.8 |
| 4,033,060 | 7/1977 | Lawrence | 40/760 |
| 4,079,881 | 3/1978 | Sabb | 229/92.8 |
| 4,450,638 | 5/1984 | Bader | 40/774 |
| 4,780,975 | 11/1988 | Friedman | 40/755 |
| 4,947,566 | 8/1990 | Hoebel | 40/773 |
| 5,740,957 | 4/1998 | Wenkmann | 229/92.8 |

*Primary Examiner*—Anthony Knight
*Assistant Examiner*—Robert L. Pilaud
*Attorney, Agent, or Firm*—Cantor Colburn LLP

[57] ABSTRACT

A postcard (2) having a frame (4) attached to a perimeter of one side of the postcard (2) and adapted to receive a photograph (or picture) such that the photograph (or picture) is securely retained between the frame (4) and postcard (2). A transparent protective view window (44) is placed between the frame (4) and photograph, both the photograph and window (44) can be inserted and removed through a flap (14) formed in the postcard (2). The postcard (2) includes strut means (16) and hook means (18) formed in the postcard (2), the strut means (16) and hook means (18) adapted to hinge outwardly from the plane of the postcard (2) and engage one another to allow the fame (4) to stand on a flat surface.

20 Claims, 2 Drawing Sheets

PICTURE FRAMED POSTCARD

This invention relates to a postcard having a frame attached thereto to enable a framed photograph or picture to be sent via postal mail.

There is previously known postcards that typically have a picture on one side, adapted from either a photograph or depicting a work of art, while on the reverse side a blank space is left for the sender of the postcard to write information on and to write details of the recipient's address. One corner of this reverse side is usually made available to affix a postage stamp.

However, people often wish to send photographs or pictures of their own to friends or colleagues via the post. Usually tis is done in a similar fashion to sending documents or letters wherein the photographs or pictures are bundled together and made secure as possible inside the package in which they are to be posted. This is generally an inconvenient and time-consuming exercise, particularly when only one photograph is required to be posted. Furthermore, there is no guarantee that the photograph(s) will not be damaged or bent during the posting and handling process.

The present invention seeks to address these problems by providing a novel postcard that allows a photograph or picture to be integrally secured to the postcard and delivered through the post.

Accordingly, the present invention provides a postcard having a frame adjacent a periphery of said postcard, said postcard adapted to receive a photograph or picture wherein said photograph or picture is securely retained between said frame and said postcard.

The postcard preferably includes a transparent protective viewing window wherein said photograph or picture is securely retained within said frame between said postcard and said transparent protective viewing window.

The postcard preferably comprises a paper-based card that is attached to a periphery of one side of said frame. Preferably the card has a flap formed integrally with the card and adapted to hinge outwardly from the plane of the card to permit insertion and removal of a photograph or picture. The flap may have a line of weakness about which the flap hinges. Preferably when a photograph/picture has been inserted to fit within the frame and the flap is in the plane of the postcard, a postage stamp is affixed to a corner of the card to cover a free edge of the flap such that the stamp is in contact with a portion of the flap and a portion of the card surrounding the flap, wherein the flap is kept closed in a secure manner. The postcard may be hermetically attached to the frame by a suitable sealant or by ultrasonic welding.

Preferably the card further comprises a strut means formed integrally with the card and adapted to hinge outwardly from the plane of the card to allow the card and frame to stand on a flat surface on either of the two adjoining edges of the frame.

The card preferably further comprises hook means formed integrally with the card and adapted to hinge outwardly from the plane of the card and adapted to engage the strut means in a slot of the strut means so as to provide additional support to the strut means and positively retain the strut means in an outwardly extended position.

The viewing window may include a sheet of clear plastic or perspex to fit in between the card and the frame so as to protect the photograph or picture.

The present invention further provides a postcard having a frame attached to a perimeter of one side of said postcard, a transparent sheet between said frame and said postcard, said sheet and said postcard defining a cavity therebetween and an access door in said postcard to allow insertion and removal of a photograph of picture into and from said cavity.

The invention will now be described in a preferred embodiment with reference to the accompanying drawings wherein.

Figure 1:
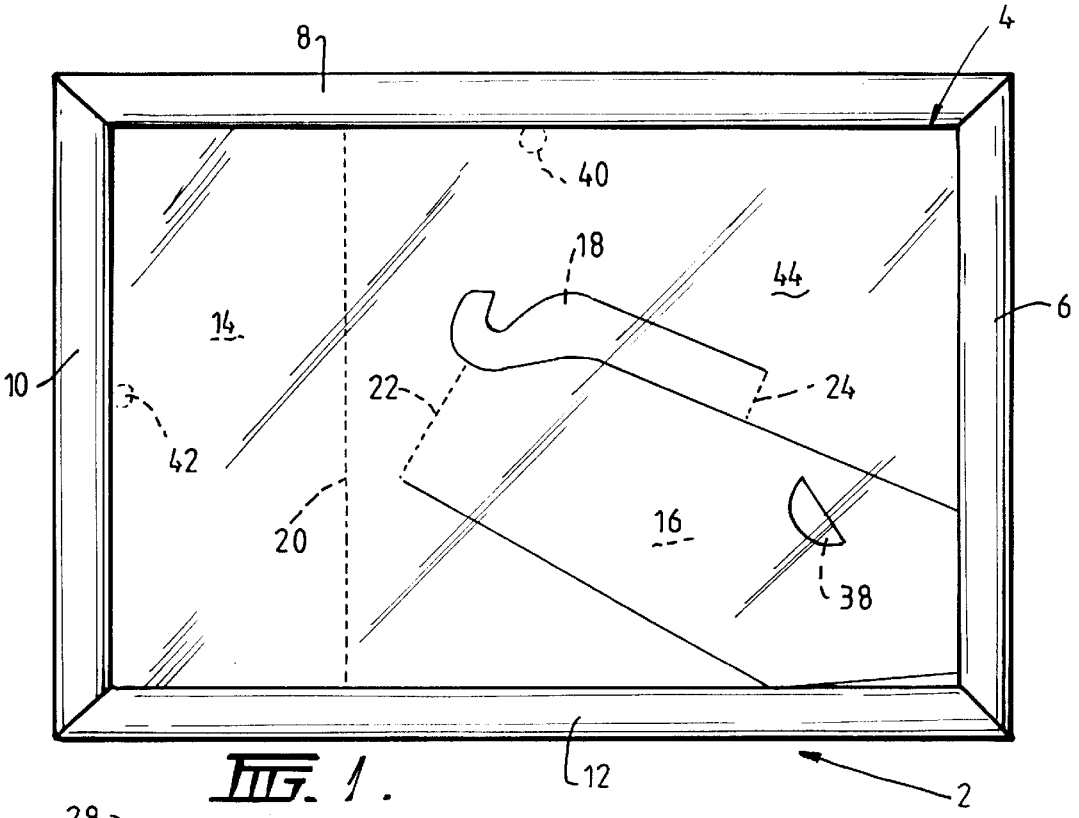
FIG. 1 is a from view of a postcard according to the present invention.

In FIG. 1, there is shown a postcard 2 having a frame 4 which is of a generally rectangular shape having long sides 8 and 12 and short sides 6 and 10. The postcard 2 has a card 5 which is preferably paper-based and is sealingly attached along the periphery of frame 4. The card 5 may be attached to the frame 4 by any suitable sealant, preferably by using ultrasonic welding. The card 5 incorporates a flap or access door 14, strut means 16 and hook means 18. In both FIGS. 1 and 2 each of the flap 14, strut means 16 and hook means 18 are shown in a closed position formed integrally with the card 5. Their particular shape is impressed on the card 5 or cut with suitable cutting means. The flap 14 has a line of weakness 20 shown in phantom that act is as a hinge. The flap also has a free edge 21 which is formed by a cut in the card 5. Similarly, strut means 16 has a line of weakness 22 that also acts as a hinge as does the line of weakness 24 for hook means 18. Both hook means 18 and strut means 16 share a common edge 26 which is also cut in card 5. The periphery of the strut means 16, except line of weakness 22, and the periphery of the hook means 18, except line of weakness 24, is cut in the card 5.

Figure 2:
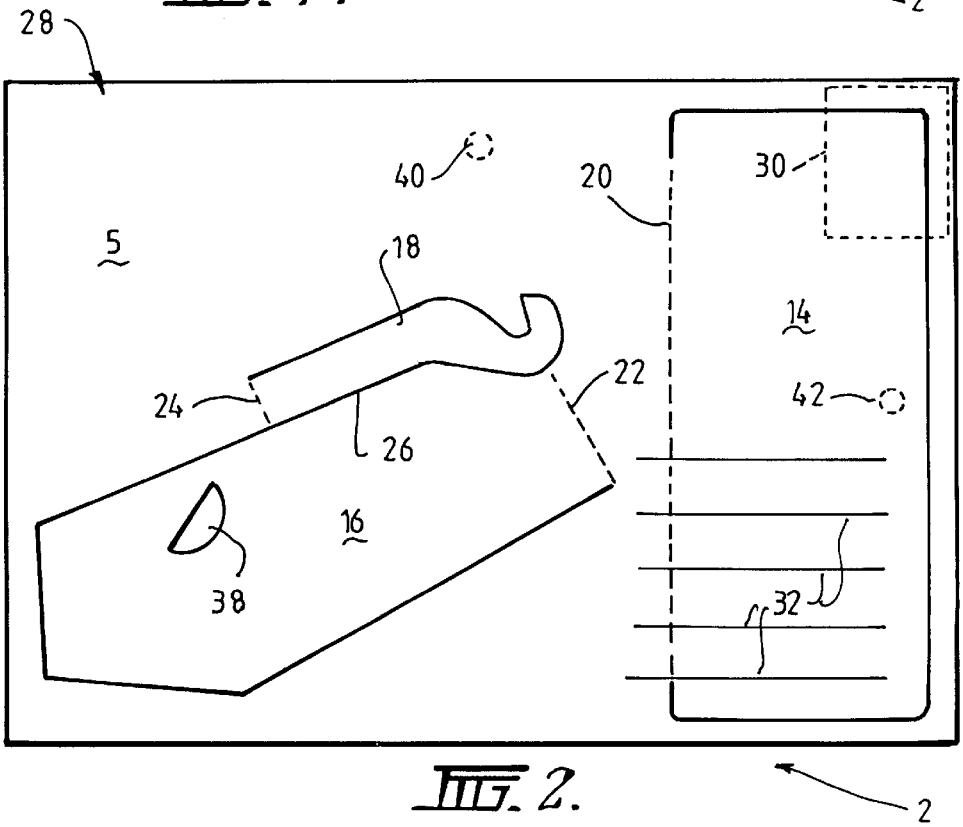
FIG. 2 is a rear view of the postcard of FIG. 1.

The flap or access door 14 may be opened by applying finger pressure from the front of the frame on the front side of card 5 so that the flap or door 14 hinges about line of weakness 20 to an open position. This permits the user to insert a photograph or picture substantially the same size as the card 5 and frame 4. When the photograph or picture has been inserted and positioned within the frame 4 the flap 14 may be pressed firmly down to a closed position so that it lies within the plane of card 5. To further secure the flap 14 in the closed position a postage stamp is affixed to one corner of the card, which is corner 28 as seen in FIG. 2, such that the stamp occupies the space 30, enclosed by the dotted lines, on card 5 and overlaps a portion of the flap 14 and portions of the card 5.

Either before the insertion of the photograph or after insertion of the photograph a user or sender may use the space on the rear side card 5 to write information in the usual manner that the postcards are written and to use lines 32 to insert the recipient's address.

Figure 3:
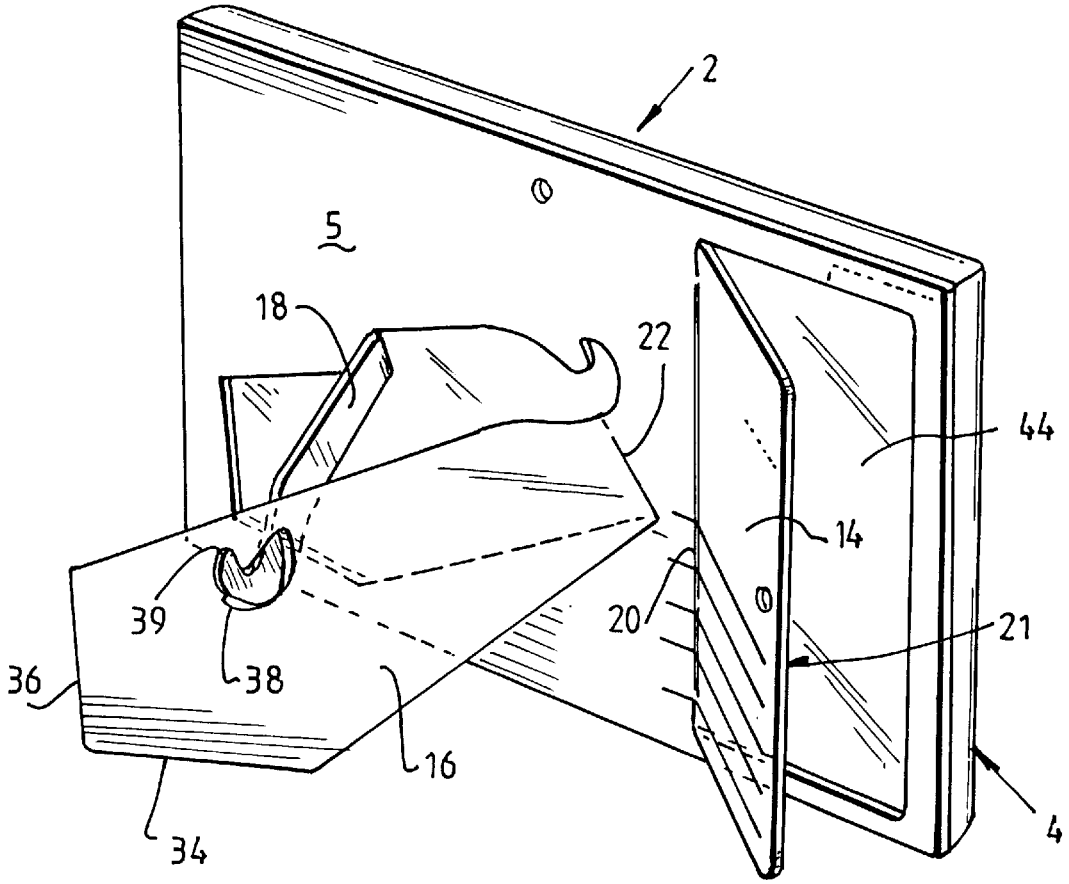
FIG. 3 is a perspective rear view of the postcard of FIG. 1 showing the postcard in a standing position.

With reference to FIG. 3, the flap 14 is shown in an open position such that it is positioned at an angle to the plane of card 5 and as mentioned previously, it allows for the insertion or removal of the photograph. So that the postcard 2 may be resting on a flat surface on either of the two adjoining sides or edges of the frame 4, the strut means 16 is moved to an open position by Applying finger pressure from the front side of card 5 and pushing strut means 16 out at an angle to the plane of card 5 as shown by die arrow in FIG. 3. The hook means 18 is then moved out at an angle such that it hinges about line of weakness 24 and this is done by applying finger pressure from the front of card 5 in the area of hook means 18. The strut means 16 has either edges 34 or 36 resting on a that surface to allow one of two orientations of the postcard 2 wherein the frame 4 stands on either of edges or sides 6 and 12. To provide additional support for the strut means 16, the hook means 18 is engaged with the strut means 16 through arcuate slot 38. In particular the distal end 39 of the hook means is adapted to engage the slot 38 so as to provide additional support for the strut means 16 in a standing position and positively retain the strut means 16 in an open and extended position. This provides for a display photograph with the postcard in a standing position. When not in use the hook means 18 can he easily unhooked from slot 38 and then folded back with the strut means 16 into a closed position in the plane of card 5.

So that the postcard can be hung from a nail or similar means on a wall or support structure, holes 40 and 42 are provided adjacent sides 8 and 10 respectively of the frame 4. These holes are initially punched so that they remain intact and when they are required to be used can easily be pushed nut to remove the inner material of the holes so that the nail or similar means can hang the frame 4. Each of the holes 40 and 42 are integral with the card 5.

Additionally, a transparent protective viewing window 44 in the form of a sheet of clear plastic such as perspex may be inserted between the frame 4 and the card 5 through the opening of flap 14, the viewing window 44 providing protection for the photograph or picture which is to be inserted or removed thereafter. The transparent sheet 44 is inserted so that it remains on the some side of the frame 4 as the card 5. A cavity is thereby defined between the sheet of clear plastic and the card into which a photograph or picture is inserted through the flap or access door 14.

This invention provides an easy and convenient way of sending a picture or photograph through the mail that is fitted within the frame which has affixed to one side a card on which information may be written in similar manner to a conventional postcard. It also has an added advantage of being able to be used as a frame which can stand in either a vertical or horizontal position on a flat surface or be hung from a wall.

What is claimed is:

1. A postcard having a frame adjacent a periphery of said postcard, said postcard being configured to allow the insertion and removal of a separate photograph or picture wherein said photograph or picture is substantially the same size as or smaller than said frame and said postcard and wherein said photograph or picture is securely retainable between said frame and said postcard, said postcard further being adapted to be sent by postal mail and having a space provided for information and an address of a recipient of the postcard;

further including strut means formed in said postcard and adapted to hinge outwardly from a plane of said postcard to allow said postcard and said frame to stand on a flat surface;

further including hook means adjacent to said strut means and sharing a common edge formed in said postcard and adapted to hinge outwardly from the plane of said postcard in a direction opposite to said strut means.

2. The postcard of claim 1, further including a transparent protective viewing window wherein said photograph or picture is securely retainable within said frame between said postcard and said transparent protective viewing window.

3. The postcard of claim 1, wherein said frame is attached to the periphery of one side of said postcard.

4. The postcard of claim 2, further including a flap formed in said postcard, wherein said flap is adapted to hinge outwardly from a plane of said postcard to permit insertion and removal of said photograph or picture.

5. The postcard of claim 1, wherein said frame stands on one of either two adjoining edges of said frame.

6. The postcard of claim 4, wherein said flap has a line of weakness about which said flap hinges, said flap including a free edge.

7. A postcard having a backing member being planar in structure, a frame member positioned adjacent to the periphery of a side of said backing member and secured to said side of said backing member so as to allow a photograph or a picture to be inserted and retained therebetween, a transparent protective viewing window securely retained between said frame and said backing member and positioned to allow the viewing of said photograph or said picture therethrough, and a flap formed in said postcard, said flap being adapted to hinge outwardly from a plane of said postcard to permit the insertion and removal of said photograph or said picture, said flap including a line of weakness about which said flap hinges and a free edge, and wherein said flap is kept in a closed position by affixing a postage stamp to cover said free edge such that said postage stamp contacts a portion of said flap and a portion of said postcard surrounding said flap.

8. The postcard of claim 1, wherein said hook means is adapted to engage said strut means to provide additional support to said strut means and positively retain said strut means in an outwardly extended position.

9. The postcard of claim 1 comprising a paper-based card.

10. The postcard of claim 2, wherein said transparent protective viewing window comprises a sheet of plastic material.

11. The postcard of claim 10, wherein said plastic material is perspex.

12. The postcard of claim 3, wherein said frame is attached to said postcard hermetically by a sealant.

13. The postcard of claim 3, wherein said frame is attached to said postcard hermetically by ultrasonic welding.

14. A postcard having a frame attached to a perimeter of one side of said postcard, a transparent sheet between said frame and said postcard, said sheet and said postcard defining a cavity therebetween, and an access door in said postcard to allow insertion and removal of a photograph or picture into and from said cavity, wherein said photograph or picture is substantially the same size as or smaller than said frame and said postcard, said postcard further being adapted to be sent by postal mail and having a space provided for information and an address of a recipient of the postcard;

further including strut means formed in said postcard and adapted to hinge outwardly from a plane of said postcard to allow said postcard and said frame to stand on a flat surface;

further including hook means adjacent to said strut means and sharing a common edge formed in said postcard and adapted to hinge outwardly from the plane of said postcard in a direction opposite to said strut means.

15. The postcard of claim 14, wherein said transparent sheet is insertable between said frame and said postcard through said access door.

16. The postcard of claim 14, wherein said access door is formed in said postcard and is adapted to hinge outwardly from a plane of said postcard to permit insertion and removal of said photograph or picture into and from said cavity.

17. The postcard of claim 16, wherein said frame stands on one of either two adjoining edges of said frame.

18. The postcard of claim 16, wherein said access door has a line of weakness about which said access door hinges, said access door including a free edge.

19. A postcard having a backing member being planar in structure, a frame member attached to a perimeter of one side of said backing member, a transparent sheet positioned between said frame and said backing member to define a cavity therebetween, and an access door in said postcard to allow for the insertion and removal of a photograph or picture into and from said cavity said access door being formed in said postcard and adapted to hinge outwardly from a plane of said postcard, said access door including a line of weakness about which said access door hinges and a free edge, and wherein said access door is kept in a closed position by affixing a postage stamp to cover said free edge such that said postage stamp contacts a portion of said access door and a portion of said postcard surrounding said access door.

20. The postcard of claim 16, wherein said hook means is adapted to engage said strut means to provide additional support to said strut means and positively retain said strut means in an outwardly extended position.

* * * * *

UNITED STATES PATENT AND TRADEMARK OFFICE

CERTIFICATE OF CORRECTION

PATENT NO. : 6,082,033
DATED : July 4, 2000
INVENTOR(S) : Gary Raymond Skinner

It is certified that error appears in the above-identified patent and that said Letters Patent is hereby corrected as shown below:

Title page,
ABSTRACT,
Line 5, after "protective", delete "view" and insert therefor -- viewing --
Line 12, after "to allow the", delete "fame" and insert therefor -- frame --

Column 1,
Line 13, after "usually", delete "tis" and insert therefor -- this --

Column 2,
Line 2, after "is a", delete "from" and insert therefor -- front --
Line 23, "phantom that", delete "act is" and insert therefor -- acts --
Line 59, after "shown by", delete "die" and insert therefor -- the --
Line 64, after 'on a", delete "that" and insert therefor -- flat --

Column 3,
Line 15, after "pushed", delete "nut" and insert therefor -- out --
Line 24, "on the", delete "some" and insert therefor -- same --

Signed and Sealed this

Second Day of April, 2002

*Attest:*

*Attesting Officer*

JAMES E. ROGAN
*Director of the United States Patent and Trademark Office*